US006277785B1

(12) United States Patent
Narita et al.

(10) Patent No.: US 6,277,785 B1
(45) Date of Patent: Aug. 21, 2001

(54) THERMAL TRANSFER IMAGE-RECEIVING SHEET

(75) Inventors: Satoshi Narita; Takayuki Imai, both of Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/271,881

(22) Filed: Mar. 18, 1999

(30) Foreign Application Priority Data

Mar. 31, 1998 (JP) ..... 10-104031
Mar. 31, 1998 (JP) ..... 10-104032

(51) Int. Cl.[7] ..... B41M 5/035; B41M 5/38

(52) U.S. Cl. ..... 503/227; 427/146; 427/195; 428/211; 428/336; 428/409

(58) Field of Search ..... 8/471; 503/227; 428/195, 336, 409, 211; 427/146, 195

(56) References Cited

U.S. PATENT DOCUMENTS 5,302,575 * 4/1994 Nogawa et al. ..... 503/227

* cited by examiner

*Primary Examiner*—Bruce H. Hess
(74) *Attorney, Agent, or Firm*—Parkhurst & Wendel, LLP

(57) ABSTRACT

The present invention provides a thermal transfer image-receiving sheet with a dye receiving layer formed from a powder composition, the thermal transfer image-receiving sheet having a dye receiving layer which gives high-quality transfer images and has satisfactory printing sensitivity, as well as production process whereby the thermal transfer image-receiving sheet can be consistently obtained; the thermal transfer image-receiving sheet 1 has a dye receiving layer 3 formed from a powder composition composed mainly of a dye-tingible resin on a base 2 made of a paper, and the dye receiving layer 3 is formed to a substantial thickness of 7 $\mu$m or greater.

5 Claims, 2 Drawing Sheets

THERMAL TRANSFER IMAGE-RECEIVING SHEET

BACKGROUND OF THE INVENTION

The present invention relates to a thermal transfer image-receiving sheet used in combination with a sublimation thermal transfer sheet, and more specifically it relates to a thermal transfer image-receiving sheet obtained by forming a dye receiving layer on ordinary paper using a powder composition.

Conventionally known thermal transfer recording-type image-receiving sheets employing sublimable dyes are made by coating the surface of a base (substrate) sheet such as synthetic paper or the like with a composition containing a resin having dye tingibility, and drying it to form a dye receiving layer.

Conventional dye receiving layers use solvent-type coating compositions, but in recent years the use of powdered coating compositions has been proposed as compositions for dye receiving layers (for example, Japanese Patent Laid-Open Publication Nos. 8-112974, 8-224970).

Such powdered coating compositions are prepared by melt kneading and cooling a composition comprising a resin component, whitener, static-control agent, anti-offsetting agent, etc., and then crushing it and sorting it to a suitable mean particle size. For production of the image-receiving sheet, the powdered coating composition is adhered to the surface of the sheet serving as the base such as ordinary paper by a method such as the electrostatic powder coating method, and then heating, pressurizing, or heating and pressurizing it for fixing to form the dye receiving layer. The image-receiving sheet features a simpler production process and layer structure.

However, forming dye receiving layers using powdered coating compositions is different from production of image-receiving sheets by formation of dye receiving layers on the surface of synthetic paper or the like using solvent-type coating compositions, and several problems have become apparent.

Specifically, because powdered coating compositions are coated onto the base surface in a powdered state, spaces are present between the powder particles, whereby a completely continuous coating is not formed even after fixing by heating and pressurization, and fine gaps and spaces are therefore present. In addition, when powdered coatings are coated onto the surfaces of porous bases such as ordinary paper, the coating compositions penetrate into the gaps in the pulp. The coated powdered coating further penetrates to the interior of the base due to the heating and pressurization for fixing.

Thus, when forming a dye receiving layer by coating a powder composition on the surface of ordinary paper, the actual thickness of the dye receiving layer formed is not a constant thickness corresponding to the coating amount even if the coating amount is kept constant as with conventional coating. Thus the dye receiving layer is strongly influenced by surface irregularities, etc. arising from the form of the pulp of the ordinary paper, so that it has not been possible to consistently obtain adequate printing quality and printing sensitivity.

It is therefore an object of the present invention according to its first aspect to provide a thermal transfer image-receiving sheet with a dye receiving layer formed from a powder composition, the thermal transfer image-receiving sheet having a dye receiving layer which gives high-quality transfer images and has satisfactory printing sensitivity, as well as a production process by which the thermal transfer image-receiving sheet can be consistently obtained.

According to the prior art described above, generation of roughness on the surface of the dye receiving layers resulting in lower image quality has been a problem when powder compositions are used to form dye receiving layers on the surface of ordinary paper which is used as the base.

It is therefore an object of the present invention according to its second aspect to provide a thermal transfer image-receiving sheet with a dye receiving layer formed from a powder composition, which thermal transfer image-receiving sheet can give satisfactory transfer images without generating roughness on the dye receiving layer surface when ordinary paper is used as the base.

DISCLOSURE OF THE INVENTION

First aspect

The invention according to the first aspect relates to a thermal transfer image-receiving sheet which comprises a base (substrate) and a dye receiving layer provided on the base, the dye receiving layer being formed from a powder composition composed mainly of a dye-tingible resin, wherein the base consists of a paper and the substantial thickness of the fixed dye receiving layer, as the value of the total thickness of the thermal transfer image-receiving sheet minus the thickness of the base, is 7 $\mu$m or more.

The production process for the thermal transfer image-receiving sheet of the invention is a process for producing a thermal transfer image-receiving sheet wherein a powder composition composed mainly of a dye-tingible resin is applied onto the surface of a base made of ordinary paper and the applied composition is fixed onto the surface of the base, to form a dye receiving layer on the base, wherein the fixing is accomplished so that the substantial thickness of the dye receiving layer after fixing, defined as the value of the total thickness of the thermal transfer image-receiving sheet minus the thickness of the base, is 7 $\mu$m or greater.

Second aspect

The invention according to the second aspect relates to a thermal transfer image-receiving sheet having a dye receiving layer formed from a powder composition composed mainly of a dye-tingible resin on a base (substrate) comprising a paper, the thermal transfer image-receiving sheet being characterized in that the surface properties of the ordinary paper are such that the texture has a roughness index value of 471 or lower, and for the surface roughness defined by JIS B 0601, the center-line average roughness (Ra) is less than 2.1 $\mu$m, the maximum height (Rmax) is less than 23.2 $\mu$m and the ten-point average roughness (Rz) is less than 20.8 $\mu$m.

DETAILED DESCRIPTION OF THE INVENTION

First aspect

Figure 1:
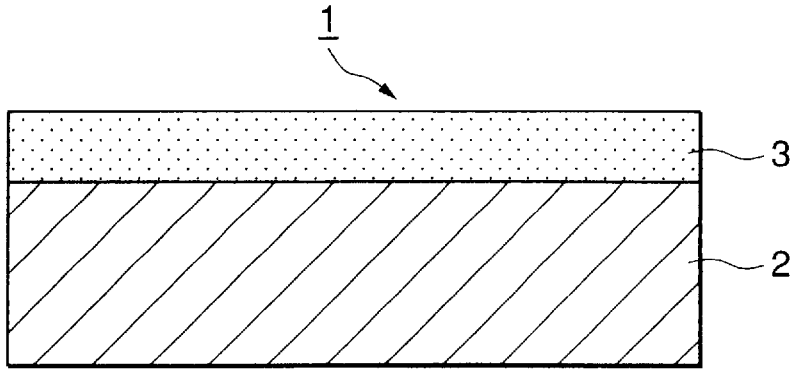
FIG. 1 is a cross-sectional view of an embodiment of a thermal transfer image-receiving sheet of the invention.

The present invention will now be explained in detail according to its first aspect, based on the drawings. As shown in FIG. 1, the thermal transfer image-receiving sheet 1 of the invention is a thermal transfer image-receiving sheet having at least a dye receiving layer 3 formed from a powder composition composed mainly of a dye-tingible resin on a base (substrate) 2 made of ordinary paper, and the dye receiving layer is formed to a substantial thickness of 7 μm or greater.

The substantial thickness of the dye receiving layer 3 refers to the actual thickness of the dye receiving layer 3 after fixing. For common formation of resin layers by coating of solvent-type coating compositions on the surfaces of non-penetrable plastic films and the like, assuming continuous formation of the coating whereby a layer is formed by simple evaporation of the solvent without generating spaces, cracks and so forth inside the resin layer and without penetration of the coating composition into the film, the thickness of the resin layer can be determined from the coating amount and density according to the following equation, without measuring the actual thickness.

Coating layer thickness (μm)=coating amount per unit area ($g/m^2$)/powder composition density ($g/cm^3$)

Figure 2A:
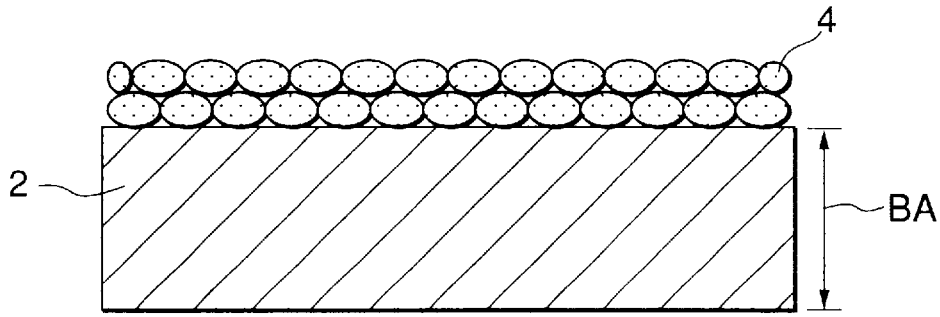
FIG. 2A and FIG. 2B are process diagrams illustrating a production process for a thermal transfer image-receiving sheet of the invention, FIG. 2A showing the powder composition coated onto the base and FIG. 2B showing the thermal transfer image-receiving sheet after fixing.
Figure 2B:
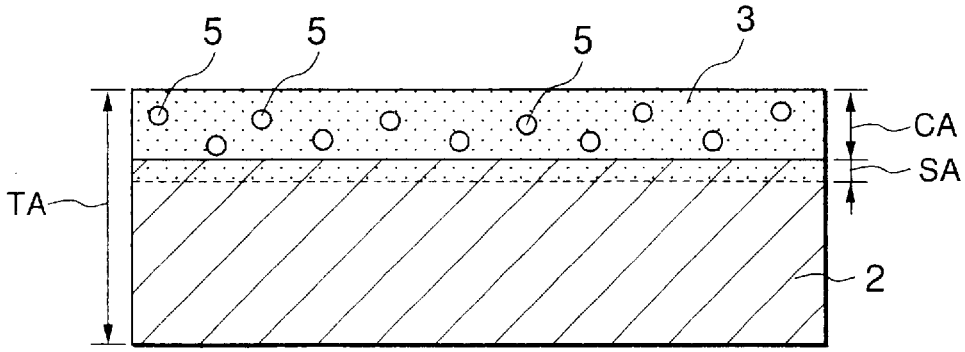

In practice, however, when the powder composition 4 is coated onto the surface of the base 2 as shown in FIG. 2A, and the coating layer consisting of the powder composition forms a coating by melting of the powder particles under heating and pressurization during fixing, the resulting layer does not completely melt to form a uniform continuous coating and therefore spaces 5 or cracks are present in the interior, as shown in FIG. 2B. When paper is used as the base, the powder composition penetrates into gaps in the paper pulp, forming a layer with a thickness of SA in the paper. Since the thickness of the dye receiving layer formed from the powder composition in this manner is governed by the heating and pressurizing conditions during fixing, by the type of paper and by the composition of the powder, it cannot be simply represented by the above equation based on the relationship between the coating amount and the coating composition density.

The substantial thickness of the dye receiving layer (CA) is the value of the total thickness (TA) minus the base thickness (BA), as represented by the following equation.

Coating layer thickness CA (μm)=total thickness (TA) (μm)−base thickness (BA) (μm)

In this equation, the total thickness and base thickness are both measured values.

The present inventors have found that in the case of a receiver layer formed from a powder composition, the substantial thickness of the receiver layer (CA) has a major effect on the printing performance, including the printing quality and printing sensitivity.

If the substantial thickness of the dye receiving layer 3 is less than 7 μm, it will be strongly affected by the surface irregularities caused by the form of the pulp of the ordinary paper base, making it impossible to achieve sufficient printing quality and printing sensitivity. As long as the substantial thickness of the dye receiving layer is at least 7 μm the printing quality and printing sensitivity will both be satisfactory, and there is no particular upper limit; however if the dye receiving layer is thicker than necessary there will be a cost increase, and therefore 30 μm is a preferred upper limit for the substantial thickness.

The substantial thickness of the dye receiving layer can be determined by actually measuring the thickness of the ordinary paper base prior to coating and the thickness of the thermal transfer image-receiving sheet after formation of the dye receiving layer by coating and fixing of the powder composition. Even if the dye receiving layer is a non-continuous coating layer with spaces, cracks and the like formed in its interior, it is sufficient if the substantial thickness is at least 7 μm. As methods for achieving a thickness of at least 7 μm there may be mentioned a method whereby 1) the coating amount of the powder composition is kept at or above a constant value and 2) the heating temperature and pressurization pressure are limited to control melting of the powder composition and its penetration into the ordinary paper.

The ordinary paper used as the base 2 may be paper composed mainly of pulp, which is commonly employed. As examples of ordinary paper there may be mentioned high-quality paper, art paper, light weight coat paper, lightly coated paper, enamel paper, cast coat paper, synthetic resin- or emulsion-impregnated paper, etc. The thickness of the ordinary paper is 40–300 μm, and preferably about 60–200 μm. In order to increase the quality feel of the ordinary paper in the resulting thermal transfer image-receiving sheet, the total thickness of the thermal transfer image-receiving sheet is preferred to be about 80–200 μm.

The dye receiving layer 3 is formed from a powder composition composed mainly of a dye-tingible resin. The powder composition may contain, in addition to the dye-tingible resin, a release agent to prevent fusion of the dye receiving layer with the thermal transfer sheet, a static-control agent to adjust the static properties of the powder coating, a whitening agent to impart opacity, an anti-offsetting agent, a flow enhancer, or the like.

As examples of dye-tingible resins there may be mentioned saturated polyester resins, polyamide resins, polyacrylic acid ester resins, polycarbonate resins, polyurethane resins, polyvinyl acetal resins, polyvinyl chloride resins, polyvinyl acetate resins, polystyrene resins, styrene-acrylic resins, styrene-butadiene copolymer resins, vinyl chloride-vinyl acetate copolymer resins, vinyl toluene-acrylic resins and cellulose-based resins. These resins can be used alone or in mixtures of two or more. If the amount of the dye-tingible resin added is less than 70 wt % of the powder composition, the dye tingibility will not be adequately exhibited risking possible reduction in printing sensitivity, and therefore it is preferably used at 70 wt % or greater in the powder composition.

The releasing agent used may be silicone oil, a phosphoric acid ester-based plasticizer or fluorine-based compound or any of various waxes, but silicone oil is preferred. Silicone oils preferred for use are epoxy-modified, alkyl-modified, amino-modified, carboxyl-modified, alcohol-modified, fluorine-modified, alkylaralkyl polyether-modified, epoxy-polyether-modified, polyether-modified and other modified silicone oils, among which are preferred reaction products of vinyl-modified silicone oil and hydrogen-modified silicone oil, and reaction cured products of amino-modified silicone and epoxy-modified silicone, or active hydrogen-containing modified silicone and curing agents which react with active hydrogen. Preferred active hydrogen-containing curing agents include non-yellowing-type isocyanate compounds, specifically XDI, hydrogenated XDI, TMXDI, HDI, IPDI and their various adducts/bullets, oligomers and prepolymers. Preferred waxes are those with melting points in the range of 50–150° C., and as examples there may be mentioned liquid and solid paraffins, waxes of polyolefins such as polyethylene and polypropylene, aliphatic metal salts, fatty acid esters, partially saponified fatty acid esters, higher fatty acid esters, higher alcohols, silicone varnish, amide-based waxes, aliphatic fluorocarbons and their modified forms. The amount of the releasing agent to be added is preferably 0.2–30 parts by weight to 100 parts by weight of the resin forming the dye receiving layer.

The static-control agent serves to control the static polarity and static charge of the powder composition, and any static latent image developing toner known to the prior art may be used. As examples of static-control agents with negative static properties there may be mentioned 2:1 metal azo dyes, metal complexes of aromatic oxycarboxylic and aromatic dicarboxylic acids, sulfonylamine derivatives of copper phthalocyanine dyes and sulfonic acid amide derivative dyes of copper phthalocyanine. As examples of static-control agents with positive static properties there may be mentioned quaternary ammonium compounds, alkylpyridinium compounds and alkylpicolinium compounds, as well as various types of nigrosine-based dyes. The amount of the static-control agent to be added is preferably 0.1–10 parts by weight, and especially 0.3–5 parts by weight, to 100 parts by weight of the resin in the dye receiving layer.

The whitening agent serves to add opacity and whiteness to the dye receiving layer, and as examples there may be mentioned calcium carbonate, talc, kaolin, titanium oxide, zinc oxide and the like. The amount of the whitening agent to be added is preferably 10–200 parts by weight to 100 parts by weight of the resin in the dye receiving layer. If the whitening agent is added at less than 10 parts by weight the color adjusting effect will be lacking, and if added at greater than 200 parts by weight the dispersion stability in the dye receiving layer will be poorer, and it will not be possible to achieve adequate performance of the resin in the dye receiving layer.

The flow adjuster serves to increase the flow of the powder composition, and an example thereof is hydrophobic silica.

The powder composition of the dye receiving layer may also contain coloring materials such as pigments, dyes, fluorescent brightening agents and so forth. When the thermal transfer image-receiving sheet is to be used as a proof output material for print proofing, and its color tone is matched with the corresponding printing paper, such coloring materials can be appropriately combined with the powder composition to create the desired color tone.

Preferred color tones for the dye receiving layer surface are within the following range.

$85 \leqq L^*$ $-3 \leqq a^* \leqq 3$ $-5 \leqq b^* \leqq 5$

Because a dye is used for sublimation transfer, the color tone of the print is influenced by the color tone of the surface of the receiver layer. Such influence can be avoided by rectifying the energy applied during dye transfer by the color tone of the receiver layer surface of the image-receiving sheet used, but adjustment will be more difficult if the color tone is outside of the range given above, and satisfactory visual quality feel will not be obtained. The following range is more preferred in order to obtain the quality feel of high-quality paper.

$90 \leqq L^*$ $-1 \leqq a^* < 1$ $-2 \leqq b^* < 3$

The powder composition of the dye receiving layer is composed mainly of the dye-tingible resin, and is obtained by mixing the other additives therewith, melting, kneading and uniformly dispersing the mixture, and then cooling and crushing it and if necessary sorting to the desired mean particle size. The mean particle size of the powdered coating composition is preferably 1–30 $\mu$m, and more preferably 5–15 $\mu$m.

The paper base used is preferably one with a surface color tone close to the surface color tone of the selected image-receiving sheet. This is because even if only the color tone of the receiver layer is adjusted by coating and fixing of the powder composition, the color tone of the base can be seen through it, often resulting in a different color tone than desired for the receiver layer surface. The formation is preferably accomplished such that the color difference ($\Delta E$) between the surface color tone of the base and the surface color tone of the receiver layer conforms to the following inequality.

$\Delta E \leqq 3$

In the process for producing a thermal transfer image-receiving sheet according to the invention, the thermal transfer image-receiving sheet is produced by coating the aforementioned powder composition composed mainly of a tingible resin onto the surface of a base sheet made of ordinary paper, and then heating, pressurizing or heating and pressurizing it for fixation to form a dye receiving layer. The coating of the powdered coating composition can be accomplished using an electrophotographic system or an electrostatic powder coating method.

Electrophotographic systems are based on the same principle as electrophotographic copy machines and laser printers, whereby the powdered coating composition (toner) is electrified by frictional electrification, and adhering it to an oppositely electrified drum surface by electrostatic attraction. The toner adhered to the drum surface is then transferred to the surface of the ordinary paper base, and heated for fixation. The drum is formed of an organic photoconductive material and is electrified by corona electrification or the like; when only partial electrification is done, the portions of the drum surface which correspond to the desired image are destaticized by light irradiation to create a so-called static latent image, and the powdered coating can be adhered to this latent image, and transferred and fixed to form the dye receiving layer only on the desired portions.

According to the electrostatic powder coating method, the powdered coating is carried to an electrostatic spray gun by an air current for electrification, and the powdered coating is blown from the electrostatic spray gun onto the surface of the grounded ordinary paper to adhere it to the surface of the ordinary paper by electrostatic attraction. The electrostatic spray gun has a needle-shaped or ring-shaped corona electrode near the tip of the air outlet, and the electrode applies a charge from about −20 kv to +80 kv. The powdered coating may also be stirred in a container for frictional electrification by friction with the walls of the container. The powdered coating adhered to the surface of the ordinary paper is heated to melting by infrared rays or the like and then fixed to form the dye receiving layer. The dye receiving layer is fixed by heating, pressurization or heating and pressurization.

According to the production process of the invention, the powder composition is fixed in such a manner that the thickness CA of the dye receiving layer after fixing shown in FIG. 2B is at least 7 $\mu$m. As a means of fixing to obtain a dye receiving layer thickness of at least 7 $\mu$m, the coating amount, heating temperature, pressurization pressure, etc. can be adjusted depending on the type and density of the powder composition of the dye receiving layer and the type of ordinary paper used as the base, in order to control penetration of the melted powder composition into the base or the proportion of spaces. The heating means for fixing of the dye receiving layer can be indirect heating by hot air, infrared rays, microwaves, etc. or direct heating by a hot roll, hot plate or the like. The pressurization means can be a roll, plate, etc.

Figure 3:
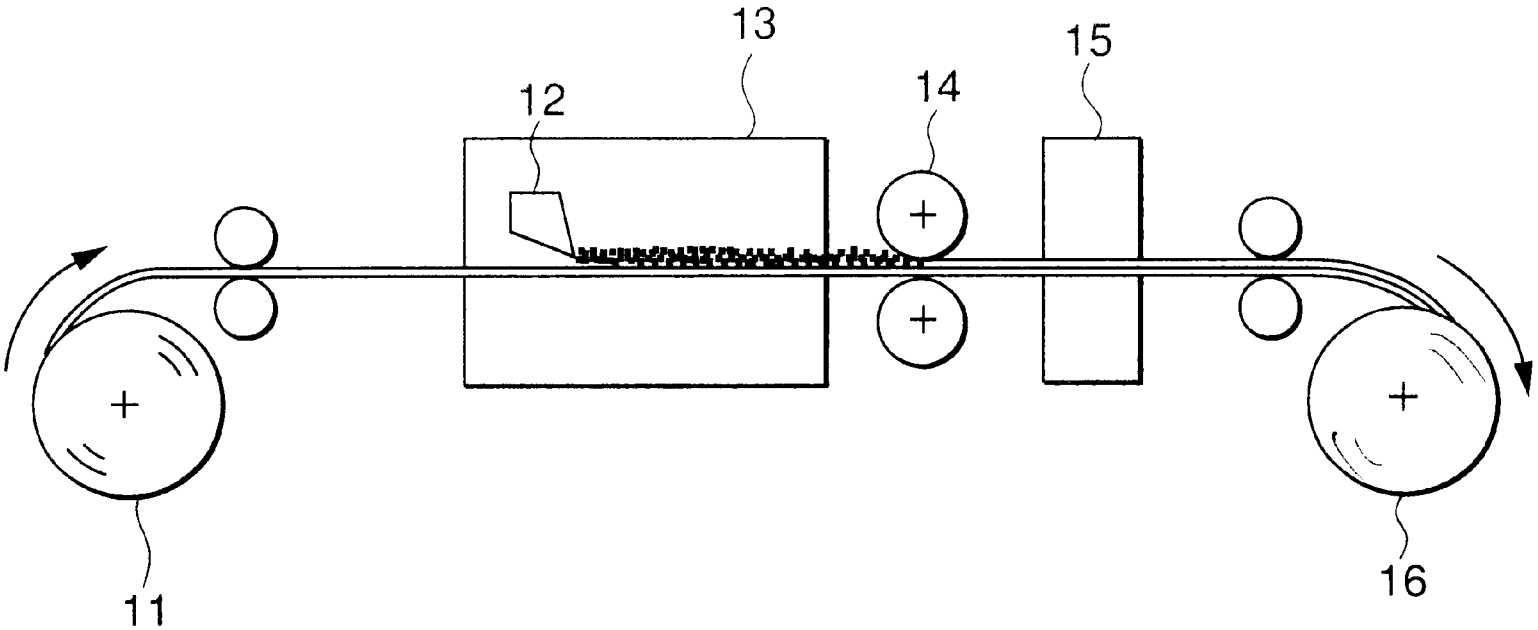
FIG. 3 is a simplified view of an embodiment of a production apparatus for a thermal transfer image-receiving sheet.

The specific production apparatus, an example of which is shown in FIG. 3, can have a structure provided with a roll 11 which supplies the ordinary paper, an electrostatic painting apparatus 13 provided with a hand-gun 12 for coating of the ordinary paper surface with the powder composition, a fixing apparatus 14 with a pressurizing and heating roller, a cooling apparatus 15, a winding apparatus for winding of the thermal transfer image-receiving sheet, etc.

When using the thermal transfer image-receiving sheet, the thermal transfer sheet used is a sublimation thermal transfer sheet for sublimation transfer recording systems. The heat energy for thermal transfer can be supplied using publicly known means, and for example, a thermal printer (such as Printer Rainbow M2720 by 3M Co.) can be used while controlling the recording time to supply thermal energy of about 5–100 mj/mm$^2$ for formation of the image.

Second aspect

The thermal transfer image-receiving sheet according to the second invention is a thermal transfer image-receiving sheet having a dye receiving layer formed from a powder composition composed mainly of a dye-tingible resin on a base made of a paper, which is characterized in that the surface properties of the paper are such that the texture has a roughness index value of 471 or lower, and for the surface roughness defined by JIS B 0601, the center-line average roughness (Ra) is less than 2.1 $\mu$m, the maximum height (Rmax) is less than 23.2 $\mu$m and the ten-point average roughness (Rz) is less than 20.8 $\mu$m.

The thermal transfer image-receiving sheet of the invention has a dye receiving layer formed from a powder composition composed mainly of a dye-tingible resin on one surface of an ordinary paper base, and the surface properties of the paper used as the base are represented by specific values for the texture and surface roughness.

The texture of the paper has a roughness value of 471 or lower. If the roughness value is greater than 471 the transferred image quality will have roughness. The roughness index can be measured using a "3-D SHEET ANALYSER M/K950" measuring apparatus by M/K SYSTEMS (U.S.). Specifically,the permeation of FLOC is measured, and the result gives a value for the roughness index.

A numerical value for the texture provides a value for the "roughness" as one of the properties of the paper. The structure of paper consists of complex (entangled) piles of pulp. Consequently, measuring the intensity of permeating light irradiated onto paper makes it possible to determine the dense portions of the pulp which absorb more light thus weakening the intensity of permeating light, and the non-dense portions of the pulp which absorb less light thus strengthening the intensity of permeating light. The roughness index is a numerical value for the "roughness" of the paper obtained by irradiating a minute region of the paper with light and scanning for measurement of the permeated light intensity across a given area. Thus, the roughness index represents the degree of change in permeating light intensity, or the "roughness". Paper with a higher roughness index than the value indicated above exhibits differences in penetration of the powder composition, so that formation of the dye receiving layer is non-uniform and the printed image quality is lowered. In contrast, paper with a small roughness index exhibits no differences in penetration of the powder composition and thus allows formation of a uniform dye receiving layer to obtain satisfactory printed image quality.

Regarding the surface roughness of the ordinary paper, the center-line average roughness (Ra) is less than 2.1 $\mu$m, the maximum height (Rmax) is less than 23.2 $\mu$m and the ten-point average roughness (Rz) is less than 20.8 $\mu$m, because if these three different surface roughness values are above the specified values, roughness will be generated in the image transferred to the dye receiving layer surface, making it impossible to obtain satisfactory image quality. The surface roughness can be measured according to JIS B 0601. The surface roughness of the paper must satisfy all of these three different values.

When the dye receiving layer is formed on only one side, the surface properties of the paper need only satisfy these physical property conditions on the one side on which the dye receiving layer is to be formed. The dye receiving layer can also be formed on both sides of the ordinary paper. In such cases, the surface properties of both sides of the ordinary paper must satisfy the conditions for the above-mentioned surface properties of texture and surface roughness.

The paper used may be paper which is composed mainly of pulp and has the surface properties described above. As examples of ordinary paper there may be mentioned high-quality paper, art paper, light weight coat paper, lightly coated paper, enamel paper, cast coat paper, synthetic resin- or emulsion-impregnated paper, etc. Particular preferred among these is non-coated paper with pulp exposed on the surface, because it allows easier penetration of the powder composition that forms the dye receiving layer, and thus better adhesion with the dye receiving layer.

The thickness of the paper is 40–300 $\mu$m, and preferably about 60–200 $\mu$m. In order to increase the quality feel of the paper in the resulting thermal transfer image-receiving sheet, the total thickness of the thermal transfer image-receiving sheet is preferred to be about 80$\mu$200 $\mu$m.

The dye receiving layer is formed from a powder composition composed mainly of a dye-tingible resin. The powder composition may contain, in addition to the dye-tingible resin, a release agent to prevent fusion of the dye receiving layer with the thermal transfer sheet, a static-control agent to adjust the static properties of the powder coating, a whitening agent to impart opacity, an anti-offsetting agent, a flow enhancer, or the like.

As examples of dye-tingible resins there may be mentioned saturated polyester resins, polyamide resins, polyacrylic acid ester resins, polycarbonate resins, polyurethane resins, polyvinyl acetal resins, polyvinyl chloride resins, polyvinyl acetate resins, polystyrene resins, styrene-acrylic resins, styrene-butadiene copolymer resins, vinyl chloride-vinyl acetate copolymer resins, vinyl toluene-acrylic resins and cellulose-based resins. These resins can be used alone or in mixtures of two or more. The dye-tingible resin is preferably used at 70 wt % or greater in the powder composition. If the amount of the dye-tingible resin added is less than 70 wt % the dye tingibility will not be adequately exhibited risking possible reduction in printing sensitivity.

The releasing agent used may be silicone oil, a phosphoric acid ester-based plasticizer or fluorine-based compound or any of various waxes, but silicone oil is preferred because it bleeds to the surface from the interior of the dye receiving layer after fixing, thus readily forming a release layer on the surface. Silicone oils preferred for use are epoxy-modified, alkyl-modified, amino-modified, carboxyl-modified, alcohol-modified, fluorine-modified, alkylaralkyl polyether-modified, epoxy-polyether-modified, polyether-modified and other modified silicone oils, among which are preferred reaction products of vinyl-modified silicone oil and hydrogen-modified silicone oil, and reaction cured products of amino-modified silicone and epoxy-modified silicone, or active hydrogen-containing modified silicone and curing agents which react with active hydrogen. Preferred active hydrogen-containing curing agents include non-yellowing-type isocyanate compounds, specifically XDI, hydrogenated XDI, TMXDI, HDI, IPDI and their various adducts/bullets, oligomers and prepolymers. Preferred waxes are those with melting points in the range of 50–150° C., and as examples there may be mentioned liquid and solid paraffins, waxes of polyolefins such as polyethylene and polypropylene, aliphatic metal salts, fatty acid esters, partially saponified fatty acid esters, higher fatty acid esters, higher alcohols, silicone varnish, amide-based waxes, aliphatic fluorocarbons and their modified forms. The amount of the releasing agent to be added is preferably 0.2–30 parts by weight to 100 parts by weight of the resin forming the dye receiving layer.

The static-control agent serves to control the static polarity and static charge of the powder composition, and any static latent image developing toner known to the prior art may be used. As examples of static-control agents with negative static properties there may be mentioned 2:1 metal azo dyes, metal complexes of aromatic oxycarboxylic and aromatic dicarboxylic acids, sulfonylamine derivatives of copper phthalocyanine dyes and sulfonic acid amide derivative dyes of copper phthalocyanine. As examples of static-control agents with positive static properties there may be mentioned quaternary ammonium compounds, alkylpyridinium compounds and alkylpicolinium compounds, as well as various types of nigrosine-based dyes. The amount of the static-control agent to be added is preferably 0.1–10 parts by weight, and especially 0.3–5 parts by weight, to 100 parts by weight of the resin in the dye receiving layer.

The whitening agent serves to add opacity and whiteness to the dye receiving layer, and as examples there may be mentioned calcium carbonate, talc, kaolin, titanium oxide, zinc oxide and the like. The amount of the whitening agent to be added is preferably 10–200 parts by weight to 100 parts by weight of the resin in the dye receiving layer. If the whitening agent is added at less than 10 parts by weight the color adjusting effect will be lacking, and if added at greater than 200 parts by weight the dispersion stability in the dye receiving layer will be poorer, and it will not be possible to achieve adequate performance of the resin in the dye receiving layer.

The flow adjuster serves to increase the flow of the powder composition, and an example thereof is hydrophobic silica.

The powder composition of the dye receiving layer may also contain coloring materials such as pigments, dyes, fluorescent brightening agents and so forth. When the thermal transfer image-receiving sheet is to be used as a proof output material for print proofing, and its color tone is matched with the corresponding printing paper, such coloring materials can be appropriately combined to create the desired color tone.

Preferred color tones for the dye receiving layer are within the following range.

$85 \leqq L^*$ $-3 \leqq a^* \leqq 3$ $-5 \leqq b^* \leqq 5$

Because the dye is used for sublimation transfer, the color tone of the print is influenced by the color tone of the surface of the receiver layer. Such influence can be avoided by rectifying the energy applied during dye transfer by the color tone of the receiver layer surface of the image-receiving sheet used, but adjustment will be more difficult if the color tone is outside of the range given above, and satisfactory visual quality feel will not be obtained. The following range is more preferred in order to obtain the quality feel of high-quality paper.

$90 \leqq L$ $-1 \leqq a^* \leqq 1$ $-2 \leqq b^* \leqq 3$

The ordinary paper base used is preferably one with a surface color tone close to the surface color tone of the selected image-receiving sheet. This is because even if only the color tone of the receiver layer is adjusted by coating and fixing of the powder composition, the color tone of the base can be seen through it, often resulting in a different color tone than desired for the receiver layer surface. The formation is preferably accomplished such that the color difference ($\Delta E$) between the surface color tone of the base and the surface color tone of the receiver layer conforms to the following inequality.

$\Delta E \leqq 3$

The powder composition of the dye receiving layer is composed mainly of the dye-tingible resin, and is obtained by mixing the other additives therewith, melting, kneading and uniformly dispersing the mixture, and then cooling and crushing it and if necessary sorting to the desired mean particle size. The mean particle size of the powder composition is preferably 1–30 $\mu$m, and more preferably 5–15 $\mu$m.

The dye receiving layer is preferably formed to have a substantial thickness of at least 7 $\mu$m. The substantial thickness is the actual thickness of the dye receiving layer after fixing, and it is the value of the total thickness minus the base thickness, as represented by the following equation.

Substantial thickness of dye receiving layer ($\mu$m)=total thickness ($\mu$m)−base thickness ($\mu$m)

In this equation, the total thickness and base thickness are both measured values.

As long as the substantial thickness of the dye receiving layer is at least 7 $\mu$m it will not easily be affected by surface irregularities arising from the pulp form of the ordinary paper base, and it will thus be possible to consistently and satisfactorily achieve adequate printing quality and printing sensitivity. If the dye receiving layer is thicker than necessary there will be a cost increase, and therefore 30 $\mu$m is a preferred upper limit for the substantial thickness.

The substantial thickness of the dye receiving layer can be determined by actually measuring the thickness of the ordinary paper base prior to coating and the thickness of the thermal transfer image-receiving sheet after formation of the dye receiving layer by coating and fixing of the powder composition. Even if the dye receiving layer is a non-continuous coating layer with spaces, cracks and the like formed in its interior, it is sufficient if the substantial thickness is at least 7 $\mu$m. As methods for achieving a thickness of at least 7 $\mu$m there may be mentioned a method whereby 1) the coating amount of the powder composition is kept at or above a constant value and 2) the heating temperature and pressurization pressure are limited to control melting of the powder composition and its penetration into the ordinary paper.

In the process for producing a thermal transfer image-receiving sheet according to the invention, the thermal transfer image-receiving sheet is produced by coating the aforementioned powder composition composed mainly of a tingible resin onto the surface of a base sheet made of ordinary paper, and then heating, pressurizing or heating and pressurizing it for fixing to form a dye receiving layer. The coating of the powder composition can be accomplished using an electrophotographic system or an electrostatic powder coating method.

Electrophotographic systems are based on the same principle as electrophotographic copy machines and laser printers, whereby the powdered coating composition (toner) is electrified by frictional electrification, and adhering it to an oppositely electrified drum surface by electrostatic attraction. The toner adhered to the drum surface is then transferred to the surface of the ordinary paper base, and heated for fixation. The drum is formed from an organic photoconductive material and is electrified by corona electrification or the like; when only partial electrification is done, the portions of the drum surface which correspond to the desired image are destaticized by light irradiation to create a so-called static latent image, and the powder dye can be adhered to this latent image, transferred and fixed to form the dye receiving layer only on the desired portions.

According to the electrostatic powder coating method, the powder composition is carried to an electrostatic spray gun by an air current for electrification, and the powdered coating is blown from the electrostatic spray gun onto the surface of the grounded ordinary paper to adhere it to the surface of the ordinary paper by electrostatic attraction. The electrostatic spray gun has a needle-shaped or ring-shaped corona electrode near the tip of the air outlet, and the electrode applies a charge from about −20 kv to +80 kv. The powdered coating may also be stirred in a container for frictional electrification by friction with the walls of the container. The powdered coating adhered to the surface of the ordinary paper is heated to melting by infrared rays or the like and then fixed to form the dye receiving layer. The dye receiving layer is fixed by heating, pressurization or heating and pressurization.

The heating means for fixing of the dye receiving layer can be indirect heating by hot air, infrared rays, microwaves, etc. or direct heating by a hot roll, hot plate or the like. The pressurization means can be a roll, plate, etc.

When using the thermal transfer image-receiving sheet, the thermal transfer sheet used is a sublimation thermal transfer sheet for sublimation transfer recording systems. The heat energy for thermal transfer can be supplied using publicly known means, and for example, a thermal printer (such as Printer Rainbow M2720 by 3M Co.) can be used to control the recording time to supply thermal energy of about 5–100 mj/mm$^2$ for formation of the image.

Examples of the present invention will now be provided.

Example A1

After combining the following powder composition starting materials with a mixer, they were heated to melting and kneaded with a melt kneading machine. The mixture was cooled and solidified, and then crushed and sorted to obtain a powder composition with a mean particle size of 8 $\mu$m. Hydrophobic silica (RA-200H, product of Nihon Aerosil) was then combined therewith at 2 parts by weight to 100 parts by weight of the powder composition to obtain a powder composition for use as a dye receiving layer.

[Powder composition starting materials (all units: parts by weight)]

- Polyester resin (Diacron FC-611, Mitsubishi Rayon) 80 parts
- Styrene-acrylic resin (FB-206, Mitsubishi Rayon) 20 parts
- Static-control agent (Bontron P-51, Orient Chemicals) 4 parts
- Titanium oxide (TCA888, Tochem Products) 2 parts
- Amino-modified silicone (X22-349, Shinetsu Chemical Indust.) 1 part
- Epoxy-modified silicone (KF-393, Shinetsu Chemical Indust.) 1 part The electrostatic coating method described below was used to coat one side of high-quality paper with a weight of 104.7 g as the base with the above powdered coating to 10 g/m$^2$ (solid portion). This was then heated and pressurized using a hot roll under the following conditions for fixing to form a dye receiving layer, thus obtaining a thermal transfer image-receiving sheet. The thickness of the high-quality paper was measured to be 93 $\mu$m (measuring device: $\mu$-Mate, product of Sony).

[Electrostatic powder coating method]

- Electrostatic powder coating apparatus: GX5000S, product of Nihon Parkerizing Co.
- Hand-gun: GX106N, product of Nihon Parkerizing Co.

[Fixing conditions]

- Hot roll diameter: 40 mm diameter on both dye receiving layer side and back side
- Heating temperature: 140° C., both rolls
- Roll speed: 20 mm/min
- Pressurization pressure: 2 kg per 25 cm roll length
- Roll surface roughness (Ra): 0.5 $\mu$m for both rolls
- Roll specular reflection (Gs 45°): 8.0%

Examples A2–A6, Comparative Examples A1–A3

Thermal transfer image-receiving sheets were obtained in the same manner as Example A1 except that the powder dye coating amounts and fixing conditions were as listed in Table A1 below.

The total thicknesses of the thermal transfer image-receiving sheets of the examples and comparative examples were measured, the thicknesses of the dye receiving layers were determined, a "Rainbow 2720" sublimation transfer printer by 3M Co. and a dye transfer film for the same printer were used for photographic printing, and the printing quality and printing sensitivity were evaluated. The results of measurement and evaluation are listed in Table A1. The evaluation methods were the following.

[Printing quality]

A Bk monochrome density (25%/100%) solid print, a 1 dot and 2 dot width Bk monochrome (100%/100%) fine-line and a Bk monochrome (100%/100%) character image were prepared, and the prints and images were evaluated. The printing quality was evaluated visually based on the following evaluation scale.

- ○: Satisfactory, with no printing drop-outs, fine-line blurring
- Δ: Some printing drop-outs and fine-line blurring
- x: Notable printing drop-outs and fine-line blurring

[Printing sensitivity]

A Mg monochrome solid print image (70%/100%) was prepared, and the printing and sensitivity properties were evaluated. The printing sensitivity was measured with a GRETAG SPM50 and judged on the following evaluation scale.

- ○: OD value of 0.9 or greater
- Δ: OD value of 0.8 or greater, less than 0.9
- x: OD value of less than 0.8

TABLE A1

| | | Receiver layer | Fixing conditions (*1) | | Coating layer | | |
|---|---|---|---|---|---|---|---|
| | | coating amount (g/m$^2$) | Temperature | Roll speed | thickness ($\mu$m) | Printing quality | Printing sensitivity |
| Example | A1 | 10 | 140° C. | 20 mm/min | 10 | ○ | ○ |

TABLE A1-continued

| | | Receiver layer | Fixing conditions (*1) | | Coating layer | | |
|---|---|---|---|---|---|---|---|
| | | coating amount ($g/m^2$) | Temperature | Roll speed | thickness ($\mu m$) | Printing quality | Printing sensitivity |
| | A2 | 13 | 140° C. | 20 mm/min | 12 | ○ | ○ |
| | A3 | 16 | 140° C. | 20 mm/min | 16 | ○ | ○ |
| | A4 | 10 | 160° C. | 20 mm/min | 9 | ○ | ○ |
| | A5 | 10 | 170° C. | 20 mm/min | 8 | ○ | ○ |
| | A6 | 10 | 180° C. | 20 mm/min | 7 | ○-Δ | ○ |
| Comp. Ex. | A1 | 6 | 140° C. | 20 mm/min | 5 | X | X |
| | A2 | 10 | 200° C. | 20 mm/min | 6 | Δ-X | X |
| | A3 | 10 | 140° C. | 5 mm/min | 6 | Δ-X | X |

(*1) The temperature under the fixing conditions was the temperature of the upper and lower rolls, and the temperature was the same for both rolls.

As explained above, the thermal transfer image-receiving sheet of the invention employs ordinary paper as the base and has a construction such that the substantial thickness of the dye receiving layer is at least 7 $\mu m$, and it is thereby possible to obtain a thermal transfer image-receiving sheet which gives high-quality transfer images and exhibits satisfactory image sensitivity and stable quality, having a dye receiving layer formed from a powder composition.

Furthermore, in the production process for a thermal transfer image-receiving sheet of the invention whereby a powder composition composed mainly of a dye-tingible resin is coated onto the surface of a base made of ordinary paper and the coating is fixed onto the surface of the ordinary paper to form a dye receiving layer, the method of fixing is such that the substantial thickness of the dye receiving layer after fixing is at least 7 $\mu m$, and it is thereby possible to easily and consistently obtain thermal transfer image-receiving sheets with high quality of transfer images and satisfactory image sensitivity.

Examples B1–B3, Comparative Examples B1–B6

The electrostatic coating method described below was used to coat one side of ordinary paper bases having the textures and surface roughnesses listed in Table B1 with the powder compositions listed below to 10 $g/m^2$ (solid portion). This was then heated and pressurized using a hot roll under the following conditions for fixing to form dye receiving layers, thus obtaining thermal transfer image-receiving sheets.

[Preparation of powder composition]

After combining the following powder composition starting materials with a mixer, they were heated to melting and kneaded with a melt kneading machine. The mixture was cooled and solidified, and then crushed and sorted to obtain a powder composition with a mean particle size of 8 $\mu m$. Hydrophobic silica (RA-200H, product of Nihon Aerosil) was then combined therewith at 2 parts by weight to 100 parts by weight of the powder composition to obtain a powder composition for use as a dye receiving layer.

[Powder composition starting materials (all units: parts by weight)]

Polyester resin (Diacron FC-611, Mitsubishi Rayon) 80 parts

Styrene-acrylic resin (FB-206, Mitsubishi Rayon) 20 parts

Static-control agent (Bontron P-51, Orient Chemicals) 4 parts

Titanium oxide (TCA888, Tochem Products) 2 parts

Amino-modified silicone (X22-349, Shinetsu Chemical Indust.) 1 part

Epoxy-modified silicone (KF-393, Shinetsu Chemical Indust.) 1 part

[Electrostatic powder coating method]

Electrostatic powder coating apparatus: GX5000S, product of Nihon Parkerizing Co.

Hand-gun: GX106N, product of Nihon Parkerizing Co.

[Fixing conditions]

Hot roll diameter: 40 mm diameter on both dye receiving layer side and back side Heating temperature: 140° C., both rolls Roll speed: 20 mm/min Pressurization pressure: 2 kg per 25 cm roll length Roll surface roughness (Ra): 0.5 $\mu m$ for both rolls Roll specular reflection (Gs 450): 8.0%

A "Rainbow 2720" sublimation transfer printer by 3M Co. and a dye transfer film for the same printer were used for photographic printing on the thermal transfer image-receiving sheets of the examples and the comparative examples, and the printing quality of each was evaluated. The evaluation results are listed in Table B1. The evaluation was by visual judgment, and those with no surface roughness and satisfactory image quality were judged as "○" while those with surface roughness on the surface and poor image quality were judged as "x".

TABLE B1

| | | Surface properties of ordinary paper | | | | Image |
|---|---|---|---|---|---|---|
| | | Texture (*1) (roughness index) | Surface roughness ($\mu m$) | | | quality evaluation |
| | | | Ra | Rmax | Rz | |
| Example | B1 | 471 | 1.8 | 20.8 | 19.6 | ○ |
| | B2 | 469 | 2.0 | 22.9 | 20.6 | ○ |
| | B3 | 434 | 1.3 | 18.9 | 16.9 | ○ |
| Comp. Ex. | B1 | 551 | 2.1 | 23.2 | 20.8 | x |
| | B2 | 549 | 2.3 | 28.0 | 26.2 | x |
| | B3 | 511 | 2.6 | 29.6 | 26.2 | x |
| | B4 | 509 | 2.1 | 25.5 | 23.7 | x |
| | B5 | 506 | 2.0 | 24.4 | 22.6 | x |
| | B6 | 474 | 2.1 | 28.3 | 21.2 | x |

(*1) The texture was measured using a "3-D SHEET ANALYSER M/K950" measuring apparatus by M/K SYSTEMS (U.S.) as the texture meter. The measuring conditions were, sensitivity: RANGE 1 (standard sensitivity), drawing: 1.5 mm, and the measurement was by permeation.

As explained above, the thermal transfer image-receiving sheet of the present invention has a construction employing ordinary paper, wherein the surface properties of the ordinary paper used as the base are such that the texture has a roughness index value of 471 or lower, and for the surface roughness, the center-line average roughness (Ra) is less than 2.1 $\mu m$, the maximum height (Rmax) is less than 23.2 $\mu m$ and the ten-point average roughness (Rz) is less than 20.8 $\mu m$, and therefore the thermal transfer image-receiving sheet with a dye receiving layer formed from a powder composition produces no roughness on the surface of the dye receiving layer and gives satisfactory transfer images. Also, since ordinary paper is used as the base, the powder composition forming the dye receiving layer readily penetrates through the surface of the ordinary paper, providing suitable adhesion with the dye receiving layer and thus giving a product with excellent adhesion between the dye receiving layer and the base.

By using ordinary paper as the base, the image-receiving sheet after image transfer has a quality feel, such as surface gloss and thickness, comparable to prints obtained by normal printing, and in contrast to sheets using resin films or resin sheets as bases, they can be folded and stacked for books or filing, as well as a wide range of other uses. Ordinary paper is also cheaper than resin films or resin sheets, and therefore thermal transfer image-receiving sheets can be provided at lower cost.

What is claimed is:

1. A thermal transfer image-receiving sheet comprising:

a base; and a dye receiving layer provided on said base, the dye receiving layer being formed from a powder composition composed mainly of a dye-tingible resin, said base comprising a paper, and a substantial thickness of said dye receiving layer, as defined a value of a total thickness of said thermal transfer image-receiving sheet minus a thickness of said base, being 7 $\mu$m or more.

2. A thermal transfer image-receiving sheet according to claim 1, wherein the substantial thickness of said dye receiving layer is in the range of 7 $\mu$m to 30 $\mu$m.

3. A process for producing a thermal transfer image-receiving sheet wherein a powder composition composed mainly of a dye-tingible resin is applied onto a surface of a base made of a paper and said applied composition is fixed onto the surface of said base, to form a dye receiving layer on said base, wherein the fixing is accomplished so that a substantial thickness of said dye receiving layer after fixing, defined as a value of a total thickness of said thermal transfer image-receiving sheet minus a thickness of said base, is 7 $\mu$m or more.

4. A process according to claim 3, wherein the substantial thickness of said dye receiving layer is in the range of 7 $\mu$m to 30 $\mu$m.

5. A thermal transfer image-receiving sheet having a dye receiving layer formed from a powder composition composed mainly of a dye-tingible resin on a base made of a paper, a surface properties of said paper being such that a texture thereof has a roughness index value of 471 or lower, and for a surface roughness defined by JIS B 0601, a center-line average roughness (Ra) is less than 2.1 $\mu$m, a maximum height (Rmax) is less than 23.2 $\mu$m and a ten-point average roughness (Rz) is less than 20.8 $\mu$m.

* * * * *